United States Patent [19]

Markus et al.

[11] 4,194,431

[45] Mar. 25, 1980

[54] ACTIVE ARMOR

[75] Inventors: Harold Markus, Philadelphia; Joseph M. McCaughey, Ambler, both of Pa.

[73] Assignee: The United States of America as represented by the Secretary of the Army, Washington, D.C.

[21] Appl. No.: 564,497

[22] Filed: Jul. 5, 1966

[51] Int. Cl.[2] ..... F41H 5/04; F41H 5/12

[52] U.S. Cl. ..... 89/36 A; 29/527.5; 29/530; 109/84; 109/85; 428/457; 428/911

[58] Field of Search ..... 161/404, 213, 271; 89/36 A; 29/191, 183, 527.5, 530; 109/85, 84, 82, 80; 428/457, 911

[56] References Cited

U.S. PATENT DOCUMENTS

| | | | |
|---|---|---|---|
| 2,212,269 | 8/1940 | Kohler | 29/191 |
| 2,391,353 | 12/1945 | Sheridan | 89/36 |

*Primary Examiner*—Richard D. Lovering

*Attorney, Agent, or Firm*—Nathan Edelberg; Robert P. Gibson; Max Yarmovsky

[57] ABSTRACT

A liquid reactant comprising an amalgam of sodium, potassium or lithium with a small amount of water in a thin layer is provided over or in steel and like armor plate as a protection. It operates to effect embrittlement of the forward portions of projectiles which strike the armor through the layer, and thus to reduce penetration.

4 Claims, 2 Drawing Figures

ACTIVE ARMOR

This invention relates to a method and means of reducing the penetration capabilities of steel projectiles into armor plate.

The existence of modern weapons with great penetrating power has necessitated the development of complex and sometimes massive armor. This armor generally consists of plates of appropriately hardened steel of a thickness deemed sufficient to provide protection from particular kinds of on-coming projectiles. Other kinds of armor consists of plates of light alloys such as those of aluminum or magnesium or of plates of composite materials such as sandwiched layers of metals and non-metals. A major concern of the designer of armor plate is to provide maximum protection with a minimum weight of armor material.

The current state of the art of armor materials has dictated an optimum ratio of hardness to weight of armor plate practicably useable. Generally, the armor used is capable of a hgih·degree of protection while being very heavy (e.g. armored tanks) or light in weight while affording a low degree of protection (e.g. aircraft).

It is therefore, an object of the present invention to provide amethod and means of increasing the resistance of armor plate to penetration by projectiles.

It is another object of the present invention to accomplish the above object with less armor than was heretofore required.

It is a further object of the present invention to provide the above objects by making use of the embrittling effect of liquid metal reactants on solid metals.

Further objects of the invention will in part be obvious and will in part appear hereinafter.

For a fuller understanding of the nature and objects of the invention, reference should be had to the following detailed description taken in connection with the accompanying drawings wherein.

In copending application Ser. No. 564,496 filed July 5, 1966 and assigned to the assignee of the present application, the embrittling effect of wetting the surface of a solid metal with a liquid metal reactant is disclosed in detail. In particular, this disclosure refers to the embrittlement of steel at room temperature by applying to the surface of a steel object amalgams of either sodium, potassium or lithium containing from 1.0 to 2.0 percent by weight of sodium, 0.75 to 1.5 percent by weight of potassium, and 1.0 to 2.0 percent by weight of lithium. A small amount of water is intimately commingled with the particular amalgam applied (e.g. a small drop of water was added to approximately one gram of the sodium amalgam). By incorporating a thin layer of one of the above reactants between an armor plate target and an oncoming steel projectile, an embrittling of the forward portion of the projectile will be caused when it contacts the reactant, with the result that the projectile will not penetrate the armor plate to the depth it ordinarily would if the projectile were not embrittled. Consequently, as can be readily observed, by appling the present invention a higher degree of armor protection can be realized with a thinner section of armor material.

Thus, greater protection and lighter armor weight is now practicably afforded.

Figure 2:
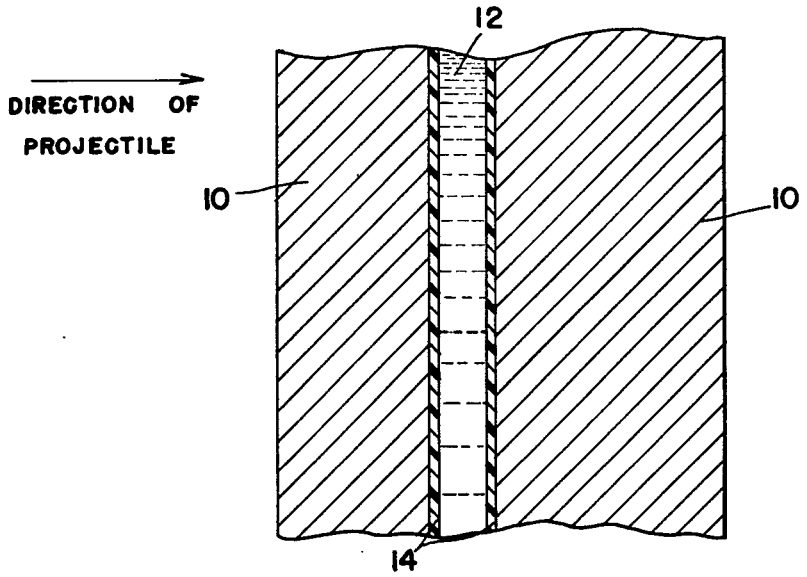
FIG. 2 is a fragmentary elevation view in cross-section of another embodiment of the present invention.

Referring now to the drawings where like reference numerals refer to like parts throughout the figures, 10 refers to an armor plate of any material suitable to a particular application. A thin film of appropriate liquid metal reactant 12 is interposed between the armor 10 and an on-coming projectile. Upon passing through the liquid film, the projectile will become wetted with the liquid metal 12, and either immediately, or upon striking the target, could be expected to break apart, thus greatly reducing its penetrating capability. The liquid reactant 12 can be very thin relative to the armor plate 10, since it is required only that the forward portion of a projectile be wetted. The liquid reactant 12 can be contained between protective layers 14 of any number of materials such as paper, plastic, glass or metal foil. The design of the armor may be varied to provide for having the film in positions other than in front of the armor plate 10. As shown in FIG. 2 the liquid reactant 12 could be located between two plates of armor 10 along with protective layers 14. The liquid metal 12 may be cast within a plate itself without the need of protective layers 14, where for example aluminum plate is used with a sodium amalgam reactant.

Figure 1:
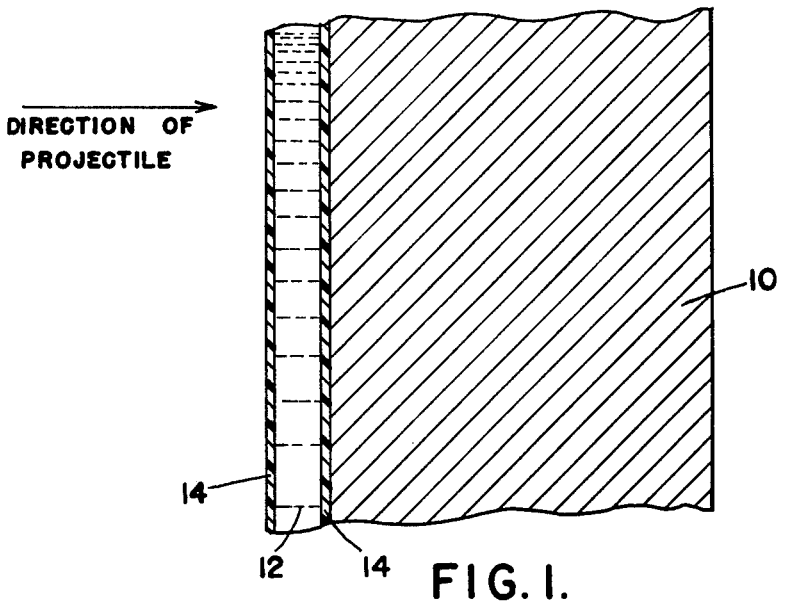
FIG. 1 is a fragmentary elevation view in cross-section of one embodiment of the present invention.

A configuration as that illustrated in FIG. 1 was tested to establish the effectiveness of the present invention. The armor plate 10 used was an aluminum alloy. A 2 percent sodium amalgam reactant 12 (with a small amount of water added) was placed between two protective layers 14 of waxed paper and secured to the outer surface of the armor plate 10. The armor plate was approximately one and a half inches thick. The thickness of the liquid reactant 12 was approximately one quarter inch. Projectiles were fixed into the inventive plate and into a like aluminum plate without a liquid reactant layer. The projectiles used were 0.30 caliber hardened steel (Rockwell C60), and were fired at a velocity of about 3050 feet per second. The results of the comparative tests showed that projectiles penetrated considerably farther into the plain aluminum plate than those fired into the inventive plate consisting of the liquid reactant layer. The projectile penetration into the plain aluminum plate were as much as twice as deep as those into the inventive plate. Recovery of projectiles after firing showed that those fired through the inventive plate broke into a number of pieces, and thus were prevented from achieving a deep penetration into the armor plate.

Resort may be had to the various modifications and variations which fall within the spirit of the invention and the scope of the appended claims.

We claim:

1. The combination with a metallic armor plate, of a protective layer of liquid reactant therefor comprising a small amount of water intimately commingled with an amalgam selected from the group consisting of sodium amalgam containing about 1 to 2 weight percent sodium, potassium amalgam containing about 0.75 to 1.5 weight percent potassium and lithium amalgam containing about 1 to 2 weight percent lithium, and means providing a relatively-thin inert barrier between the material of said plate and the protective layer.

2. A combination according to claim 1 wherein said amalgam consists of sodium amalgam.

3. A combination according to claim 1 wherein said amalgam consists of potassium amalgam.

4. A combination according to claim 1 wherein said amalgam consists of lithium amalgam.

* * * * *